US008946977B2

(12) United States Patent
Katsuraya et al.

(10) Patent No.: US 8,946,977 B2
(45) Date of Patent: Feb. 3, 2015

(54) SPARK PLUG HAVING FUSION ZONE

(75) Inventors: Kohei Katsuraya, Nagoya (JP); Katsutoshi Nakayama, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/126,930

(22) PCT Filed: Apr. 10, 2012

(86) PCT No.: PCT/JP2012/059761
§ 371 (c)(1),
(2), (4) Date: Dec. 17, 2013

(87) PCT Pub. No.: WO2013/011723
PCT Pub. Date: Jan. 24, 2013

(65) Prior Publication Data

US 2014/0139098 A1 May 22, 2014

(30) Foreign Application Priority Data

Jul. 19, 2011 (JP) ..... 2011-157351

(51) Int. Cl.
*H01T 13/20* (2006.01)
*F02P 13/00* (2006.01)
*H01T 13/39* (2006.01)

(52) U.S. Cl.
CPC ..... *H01T 13/20* (2013.01); *F02P 13/00* (2013.01); *H01T 13/39* (2013.01)
USPC ..... 313/141; 313/144

(58) Field of Classification Search
CPC ..... H01T 13/20; H01T 13/39; F02P 13/00
USPC ..... 313/118, 141, 142, 144; 445/7
See application file for complete search history.

(56) References Cited

U.S. PATENT DOCUMENTS

| | | | | |
|---|---|---|---|---|
| 6,528,929 | B1 | 3/2003 | Matsutani et al. | |
| 6,891,318 | B2 | 5/2005 | Hori et al. | |
| 7,323,810 | B2 * | 1/2008 | Orjela et al. | 313/141 |
| 2001/0022492 | A1 * | 9/2001 | Matsutani | 313/143 |

(Continued)

FOREIGN PATENT DOCUMENTS

| | | | |
|---|---|---|---|
| JP | 2000-208235 | A | 7/2000 |
| JP | 2002-216932 | A | 8/2002 |

(Continued)

OTHER PUBLICATIONS

International Search Report mailed Jul. 10, 2012 for the corresponding PCT Application No. PCT/JP2012/059761.

*Primary Examiner* — Nimeshkumar Patel
*Assistant Examiner* — Glenn Zimmerman
(74) *Attorney, Agent, or Firm* — Leason Ellis LLP.

(57) ABSTRACT

A spark plug includes a center electrode, a ground electrode, and a tip joined to the center electrode and forming a spark discharge gap with the ground electrode. The tip is joined to the center electrode via a fusion zone, which has an exposed surface exposed to the external environment. In a section containing an axis and the center of the exposed surface, C−B≥0.02 is satisfied, where C (mm) is the distance on the side surface of the tip between the fusion zone and the distal end of the tip, and B (mm) is the distance between a distal end surface of the tip and a portion of the fusion zone located closer to the axis than the side surface of the tip and located closest in the fusion zone to the distal end surface of the tip.

11 Claims, 10 Drawing Sheets

(56) References Cited

U.S. PATENT DOCUMENTS

| | | | | |
|---|---|---|---|---|
| 2006/0066195 | A1 | 3/2006 | Suzuki et al. | |
| 2009/0289540 | A1 | 11/2009 | Nunome et al. | |
| 2010/0289398 | A1* | 11/2010 | Kato et al. | 313/141 |
| 2011/0163653 | A1* | 7/2011 | Torii et al. | 313/141 |
| 2012/0086326 | A1* | 4/2012 | Niessner et al. | 313/141 |
| 2013/0069516 | A1* | 3/2013 | Sumoyama et al. | 313/141 |

FOREIGN PATENT DOCUMENTS

| | | | |
|---|---|---|---|
| JP | 2003-068421 | A | 3/2003 |
| JP | 2006-128076 | A | 5/2006 |
| WO | WO-2009/037884 | A | 3/2009 |
| WO | WO 2009037884 | A1 * | 3/2009 |
| WO | WO 2011155101 | A1 * | 12/2011 |

* cited by examiner

SPARK PLUG HAVING FUSION ZONE

CROSS-REFERENCE TO RELATED PATENT APPLICATIONS

This application is a U.S. National Phase Application under 35U.S.C. §371 of International Patent Application No. PCT/JP2012/059761, filed Apr. 10, 2012, and claims the benefit of Japanese Patent Application No. 2011-157351, filed on Jul. 19, 2011, all of which are incorporated by reference in their entirety herein. The International Application was published in Japanese on Jan. 24, 2013 as International Publication No. WO/2013/011723 under PCT Article 21(2).

FIELD OF THE INVENTION

The present invention relates to a spark plug for use in an internal combustion engine or the like.

BACKGROUND OF THE INVENTION

A spark plug for use in an internal combustion engine includes, for example, a center electrode extending in an axial direction; an insulator provided externally of the outer circumference of the center electrode; a cylindrical metallic shell externally assembled to the outer circumference of the insulator; and a ground electrode whose proximal end portion is joined to a forward end portion of the metallic shell. The ground electrode is bent at its substantially intermediate portion in such a manner that its distal end portion faces a forward end portion of the center electrode, thereby forming a spark discharge gap between the forward end portion of the center electrode and the distal end portion of the ground electrode.

In recent years, there has been proposed a technique for restraining an increase in the spark discharge gap resulting from spark discharges (for improving erosion resistance) while improving ignition performance, by means of joining a relatively-small-diameter tip formed of iridium, platinum, or the like to the forward end portion of the center electrode (refer to, for example, Japanese Patent Application Laid-Open (kokai) No. 2003-68421). According to the technique, in a state in which the tip is placed on the forward end surface of the center electrode, a laser beam is radiated to the periphery of a contact surface between the tip and the center electrode so as to form a fusion zone where the tip and the center electrode are fused together, thereby joining the tip to the center electrode. The laser beam is radiated along a direction substantially parallel to the distal end surface of the tip, and, as a result of formation of the fusion zone, a portion of the tip located toward the side surface of the tip becomes smaller in thickness than a portion of the tip located toward the center of the tip.

Problem to be Solved by the Invention

Meanwhile, since electric field strength is relatively high at the edge of the tip located between the distal end surface and the side surface of the tip, a spark discharge is likely to occur starting from the edge and its vicinity, and the edge and its vicinity are likely to have a high temperature. Thus, in the course of erosion of the tip as a result of spark discharges and the like, the edge and its vicinity are more likely to be eroded; accordingly, as a result of erosion of the edge and its vicinity to a certain extent, the distal end surface of the tip assumes a rounded shape; subsequently, the tip is eroded substantially evenly. Specifically, as shown in FIG. 16, a tip 81 undergoes erosion such that its portion located toward the side surface is eroded more than its portion located toward its center.

Therefore, according to the technique described in Japanese Patent Application Laid-Open (kokai) No. 2003-68421 mentioned above, as shown in FIG. 17, as a result of erosion of the tip 81, a portion of a fusion zone 85 located toward the outer circumference of the fusion zone 85 may be exposed to a spark discharge gap 83 at a relatively early stage. Since the fusion zone is inferior to the tip in terms of durability, exposure of the fusion zone to the spark discharge gap causes a rapid increase in the size of the spark discharge gap. As a result, an abrupt increase in discharge voltage may be incurred (i.e., durability may become insufficient). Also, the progress of erosion of the fusion zone deteriorates the joining strength of the tip, potentially resulting in separation of the tip.

In this connection, there is conceived restraint of exposure of the fusion zone to the spark discharge gap through increase in the thickness (height) of the tip. However, in this case, an increase in material cost may be incurred.

SUMMARY OF THE INVENTION

The present invention has been conceived in view of the above circumstances, and an object of the invention is to provide a spark plug which can restrain exposure of the fusion zone to the spark discharge gap over a long period of time without involvement of an increase in material cost and which eventually can drastically improve durability.

Means for Solving the Problem

Configurations suitable for achieving the above object will next be described in itemized form. If needed, actions and effects peculiar to the configurations will be described additionally.

Configuration 1: A spark plug of the present configuration comprises a center electrode extending in a direction of an axis, a tubular insulator having an axial bore into which the center electrode is inserted, a tubular metallic shell provided externally of an outer circumference of the insulator, a ground electrode disposed at a forward end portion of the metallic shell, and a tip whose proximal end portion is joined to a forward end portion of the center electrode and whose distal end portion forms a gap in cooperation with a distal end portion of the ground electrode, and the spark plug is characterized in that the tip is joined to the center electrode via a fusion zone which is formed by radiation of a laser beam or an electron beam from a lateral side of the center electrode and in which the tip and the center electrode are fused together, the fusion zone is located toward a side from which the laser beam or the electron beam is radiated, and includes an exposed surface exposed to an external environment, and in a section which contains the axis and passes through a center of the exposed surface, a relational expression $C-B \geq 0.02$ is satisfied, where C (mm) is a distance along the axis on a side surface of the tip between the fusion zone and a distal end of the tip, and B (mm) is a distance along the axis between a distal end surface of the tip and a portion of the fusion zone located closer to the axis than the side surface of the tip and located closest in the fusion zone to the distal end surface of the tip.

In the case where the laser beam or the like is radiated intermittently, the outer surface of the fusion zone has a circular peripheral line (outline). In this case, the "center of the exposed surface" means the center of the peripheral line. However, in some cases, as a result of overlap of outer surfaces of fusion zones, the peripheral line of a fusion zone is not clear-cut. In such a case, the "center of the exposed surface" means the center of an imaginary circle drawn in such a manner as to pass through a relatively clear-cut portion of the peripheral line of a fusion zone.

In the case where the laser beam or the like is continuously radiated while being moved relative to the center electrode, the outer surface of the fusion zone has a peripheral line (outline) extending along the circumferential direction of the center electrode. In this case, the "center of the exposed surface" means a point which resides on an imaginary line located at the center between a line segment of the peripheral line located on a side toward the center electrode and a line segment of the peripheral line located on a side toward the tip and which resides where the width between the line segment of the peripheral line on the side toward the center electrode and the line segment of the peripheral line on the side toward the tip is the greatest.

According to configuration 1 mentioned above, the relational expression $C-B \geq 0.02$ mm is satisfied; i.e., a portion of the tip located toward the side surface of the tip is sufficiently greater in thickness than a portion of the tip located toward the center (axis). Therefore, a large thickness is ensured for a portion of the tip whose erosion is apt to progress, so that without need to increase the thickness (height) of the tip, exposure of the fusion zone to the gap can be restrained over a long period of time. That is, according to configuration 1 mentioned above, without involvement of an increase in material cost, durability can be drastically improved, and, in turn, service life can be further elongated.

Configuration 2: A spark plug of the present configuration is characterized in that, in configuration 1 mentioned above, in the section which contains the axis and passes through the center of the exposed surface, a relational expression $30 \geq a$ is satisfied, where a (°) is an acute angle between an outline of the distal end surface of the tip and a straight line which connects a portion of the fusion zone located closest in the fusion zone to the distal end surface of the tip and a forward end portion with respect to the direction of the axis of the fusion zone on the side surface of the tip.

Needless to say, the "portion of the fusion zone located closest in the fusion zone to the distal end surface of the tip" is configured not to be exposed at the distal end surface of the tip.

According to configuration 2 mentioned above, through satisfaction of the relational expression $30° \geq a$, an inwardly located portion of the fusion zone does not excessively penetrate into the tip. Therefore, a surface of the fusion zone located on a side toward the tip is similar in shape to an eroded distal end surface of the tip; as a result, the fusion zone is not exposed to the gap until almost all of the tip is eroded away (i.e., the tip is used quite effectively). Thus, exposure of the fusion zone to the gap can be prevented over a very long period of time, so that durability can be further improved.

Configuration 3: A spark plug of the present configuration is characterized in that, in configuration 1 or 2 mentioned above, the center electrode includes an outer layer and an inner layer, which is provided in the interior of the outer layer and formed of a metal higher in thermal conductivity than a metal of the outer layer, and in the section which contains the axis and passes through the center of the exposed surface, a relational expression D 2.0 is satisfied, where D (mm) is a shortest distance between the tip and the inner layer or a shortest distance between the fusion zone and the inner layer, whichever is shorter.

According to configuration 3 mentioned above, heat of the tip can be efficiently conducted to the inner layer having superior thermal conductivity, whereby overheating of the tip can be restrained. As a result, erosion resistance and oxidation resistance of the tip can be improved, whereby durability can be further enhanced.

Configuration 4: A spark plug of the present configuration is characterized in that, in any one of configurations 1 to 3, the exposed surface is formed only on a side surface of the center electrode.

Configuration 4 mentioned above is such that the exposed surface of the fusion zone is formed only on the side surface of the center electrode (in other words, such that the exposed surface of the fusion zone is not formed on the side surface of the tip). Therefore, thickness can be ensured to the possible greatest extent for a side portion of the tip which is particularly apt to be eroded, so that erosion resistance of the tip can be further improved. Also, since the exposed surface is not formed on the side surface of the tip, quality of external appearance can be improved.

Configuration 5: A spark plug of the present configuration is characterized in that, in any one of configurations 1 to 4 mentioned above, the tip is formed of iridium, platinum, tungsten, palladium, or an alloy which contains at least one of the metals as a main component.

According to configuration 5 mentioned above, erosion resistance and oxidation resistance of the tip can be further improved, whereby durability can be further improved.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 5 is an enlarged sectional view of the fusion zone, etc., for explaining angle a.

FIG. 8 is a graph showing the results of the erosion resistance evaluation test conducted on samples which differ in angle a.

DETAILED DESCRIPTION OF THE INVENTION

Modes for Carrying Out the Invention

Figure 1:
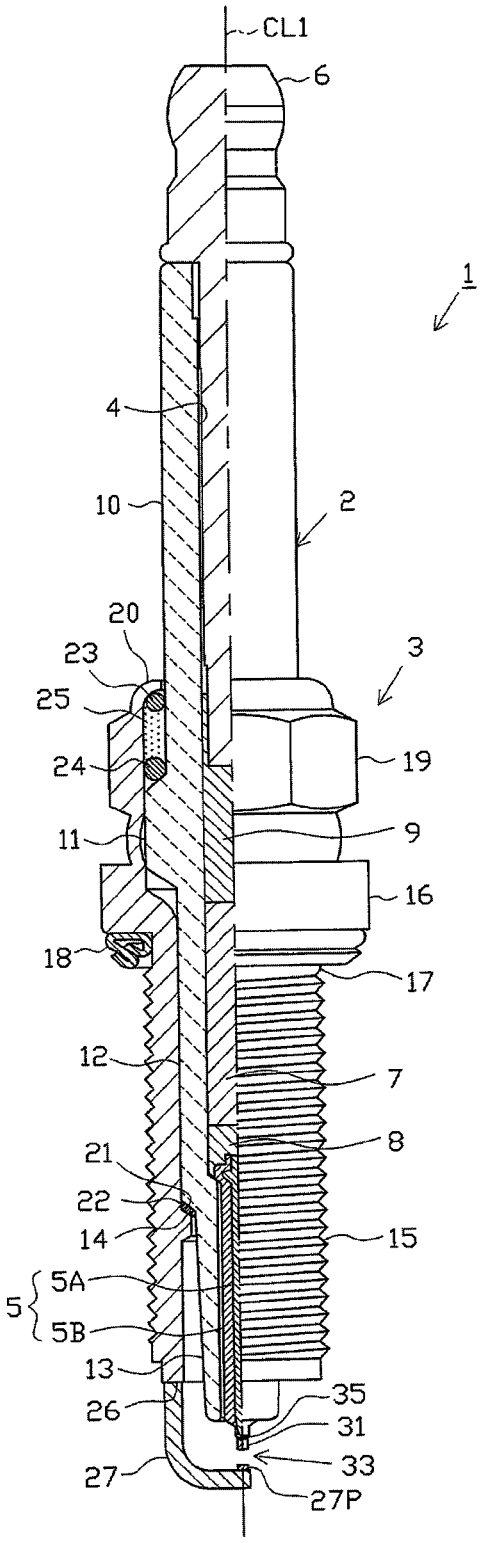
FIG. 1 is a partially cutaway front view showing the configuration of a spark plug.

An embodiment of the present invention will next be described with reference to the drawings. FIG. 1 is a partially cutaway front view showing a spark plug 1. In FIG. 1, the direction of an axis CL1 of the spark plug 1 is referred to as the vertical direction. In the following description, the lower side of the spark plug 1 in FIG. 1 is referred to as the forward side of the spark plug 1, and the upper side as the rear side.

The spark plug 1 includes a ceramic insulator 2, which corresponds to the tubular insulator of the present invention, and a tubular metallic shell 3 which holds the ceramic insulator 2 therein.

The ceramic insulator 2 is formed from alumina or the like by firing, as well known in the art. The ceramic insulator 2, as viewed externally, includes a rear trunk portion 10 formed on the rear side; a large-diameter portion 11 located forward of the rear trunk portion 10 and projecting radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. Additionally, the large-diameter portion 11, the intermediate trunk portion 12, and most of the leg portion 13 are accommodated in the metallic shell 3. A tapered, stepped portion 14 is formed at a connection portion between the leg portion 13 and the intermediate trunk portion 12. The ceramic insulator 2 is seated on the metallic shell 3 at the stepped portion 14.

Furthermore, the ceramic insulator 2 has an axial bore 4 extending therethrough along the axis CL1. A rodlike (circular columnar) center electrode 5 extending in the direction of the axis CL1 is fixedly inserted into a forward end portion of the axial bore 4. The center electrode 5 includes an inner layer 5A formed of copper, a copper alloy, or pure nickel (Ni), the metals having superior thermal conductivity, and an outer layer 5B formed of an Ni alloy which contains Ni as a main component. Furthermore, the forward end surface of the center electrode 5 protrudes from the forward end of the ceramic insulator 2.

Additionally, a proximal end portion of a circular columnar tip 31 is joined to a forward end portion of the center electrode 5. In the present embodiment, the tip 31 is formed of iridium (Ir), platinum (Pt), tungsten (W), palladium (Pd), or an alloy which contains at least one of the metals as a main component. In the present embodiment, the height of the tip 31 [a maximum distance along the direction of the axis CL1 from the distal end surface of the tip 31 to the center electrode 5 (to a fusion zone 35 to be described later in the case where the tip 31 is not in contact with the center electrode 5)] falls within a predetermined range (e.g., from 0.3 mm to 3.0 mm). Through employment of a height of the tip 31 within the predetermined range, while superior erosion resistance, etc., are implemented, an increase in material cost is restrained.

Also, a terminal electrode 6 is fixedly inserted into a rear end portion of the axial bore 4 and protrudes from the rear end of the ceramic insulator 2.

Furthermore, a circular columnar resistor 7 is disposed within the axial bore 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed into a tubular shape from a low-carbon steel or a like metal and has a threaded portion (externally threaded portion) 15 on its outer circumferential surface for mounting the spark plug 1 into a mounting hole formed in a combustion apparatus (e.g., an internal combustion engine or a fuel cell reformer). The metallic shell 3 has a seat portion 16 formed on its outer circumferential surface and located rearward of the threaded portion 15. A ring-like gasket 18 is fitted to a screw neck 17 located at the rear end of the threaded portion 15. Furthermore, the metallic shell 3 has a tool engagement portion 19 provided near its rear end, having a hexagonal cross section, and allowing a tool such as a wrench to be engaged therewith when the metallic shell 3 is to be attached to the combustion apparatus. Also, the metallic shell 3 has a crimped portion 20 provided at its rear end portion and adapted to hold the ceramic insulator 2.

Also, the metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimped portion 20 is formed, whereby the ceramic insulator 2 is fixed to the metallic shell 3. An annular sheet packing 22 intervenes between the stepped portion 14 of the ceramic insulator 2 and the stepped portion 21 of the metallic shell 3. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with powder of talc 25. That is, the metallic shell 3 holds the ceramic insulator 2 through the sheet packing 22, the ring members 23 and 24, and the talc 25.

Figure 2:
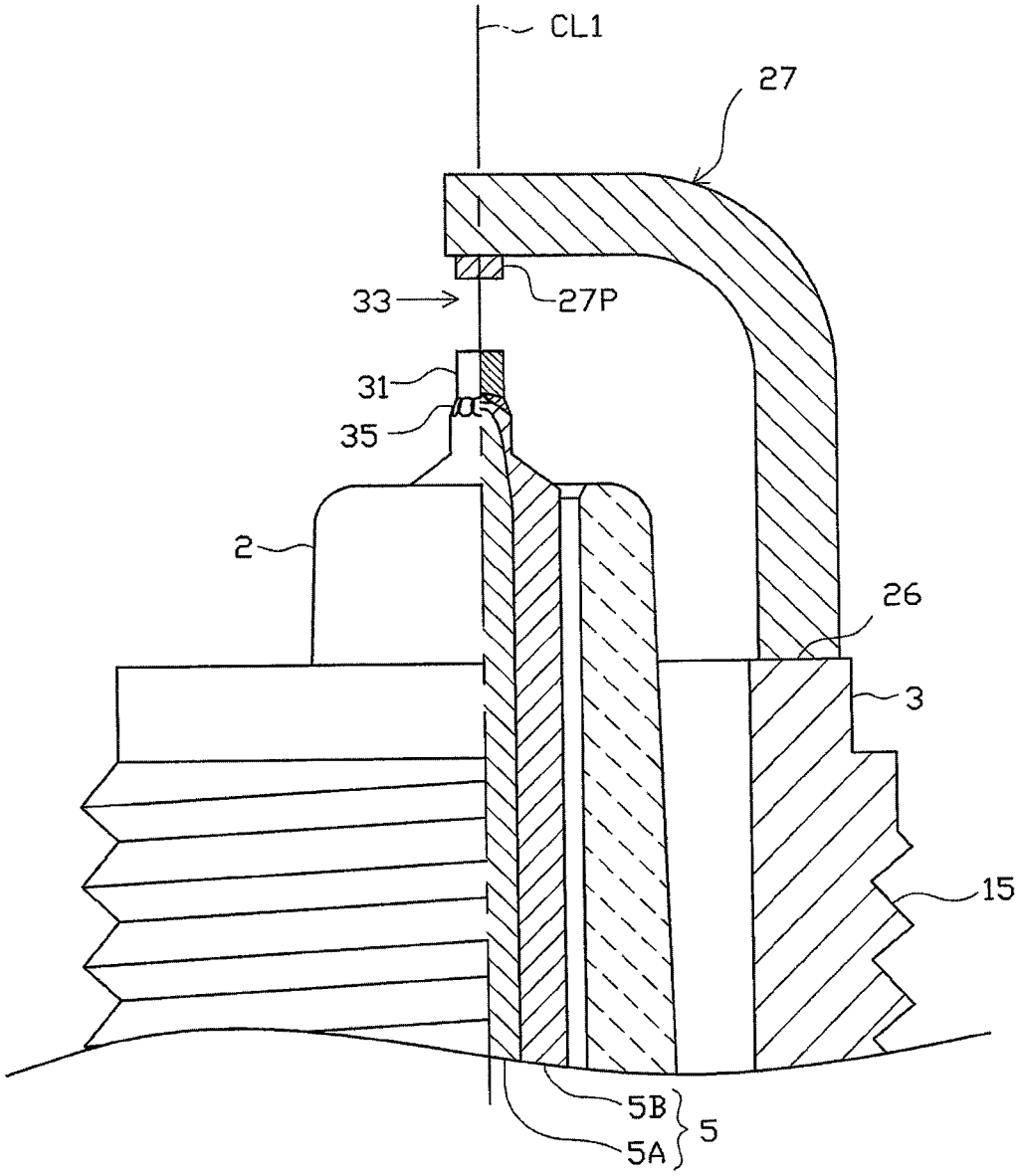
FIG. 2 is a partially cutaway enlarged front view showing the configuration of a forward end portion of the spark plug.

Also, as shown in FIG. 2, a rodlike ground electrode 27 is joined to a forward end portion 26 of the metallic shell 3. The ground electrode 27 is bent at its substantially intermediate portion and has a protrusion 27P disposed at its distal end portion and formed of Ir, Pt, W, Pd, or an alloy which contains at least one of the metals as a main component. A spark discharge gap 33, which corresponds to the gap of the present invention, is formed between a distal end portion of the tip 31 and a distal end portion (protrusion 27P) of the ground electrode 27. Spark discharges are performed across the spark discharge gap 33 in a direction substantially along the axis CL1.

Figure 3:
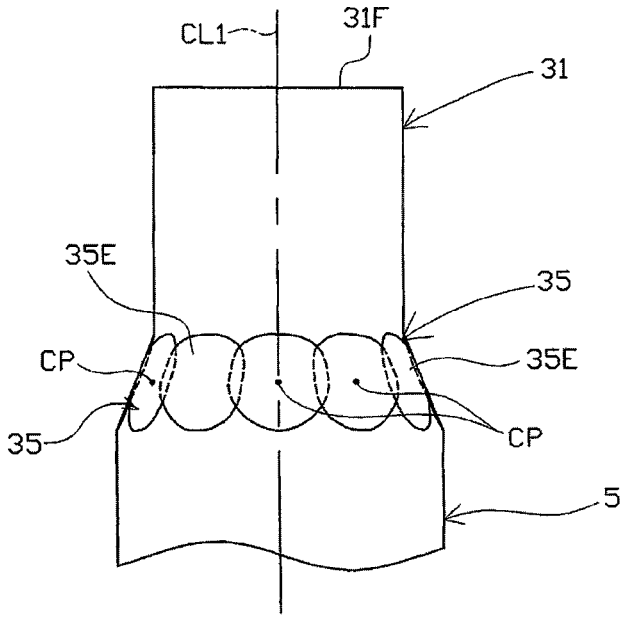
FIG. 3 is a fragmentary enlarged front view showing the configuration of fusion zones, etc.

Furthermore, in the present embodiment, the tip 31 is joined to the center electrode 5 via the fusion zone 35 where the tip 31 and the center electrode 5 are fused together. The fusion zone 35 is formed through intermittent radiation of a laser beam or an electron beam (in the present embodiment, a high-energy laser beam such as a fiber laser beam) toward the side surface (outer circumferential surface) of the center electrode 5 along the circumferential direction. Thus, as shown in FIG. 3, a plurality of the fusion zones 35 are provided in a connected manner along the circumferential direction. Each of the fusion zones 35 includes an exposed surface 35E exposed to the external environment and located on a side from which the laser beam or the electron beam has been radiated. In the present embodiment, the exposed surfaces 35E are formed in such a manner as to extend into the side surface of the center electrode 5 and into the side surface of the tip 31. Also, the fusion zones 35 are formed through radiation of the laser beam or the like from a direction which is inclined rearward with respect to the direction of the axis CL1 from a direction parallel to a distal end surface 31F of the tip 31.

Figure 4:
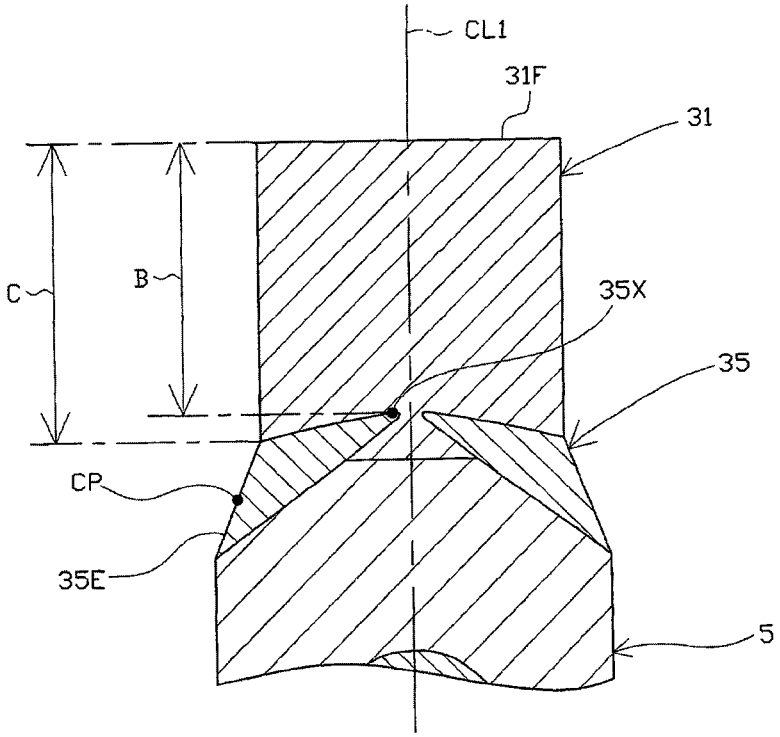
FIG. 4 is an enlarged sectional view showing the configuration of the fusion zones, etc.

Additionally, the present embodiment is configured such that, as shown in FIG. 4, in a section which contains the axis CL1 and passes through a center CP of the exposed surface 35E (a section where a most inward portion of the fusion zone 35 is considered to appear), the relational expression C−B≥0.02 is satisfied, where C (mm) is the distance on the side surface of the tip 31 along the axis CL1 between the fusion zone 35 and the distal end of the tip 31, and B (mm) is the distance along the axis CL1 between the distal end surface 31F of the tip 31 and a portion 35X of the fusion zone 35 located closer to the axis CL1 than the side surface of the tip 31 and located closest in the fusion zone 35 to the distal end surface 31F of the tip 31. That is, the present embodiment is configured such that a portion of the tip 31 located toward the side surface of the tip 31 is sufficiently large in thickness along the axis CL1 than a portion of the tip 31 located toward the center of the tip 31.

As shown in FIG. 3, the "center CP of the exposed surface 35E" means the center of the peripheral line of the exposed surface 35E. However, in the case where the peripheral line is not clear-cut as a result of overlap of the exposed surfaces 35E, the "center CP of the exposed surface 35E" means the center of an imaginary circle drawn in such a manner as to pass through a relatively clear-cut portion of the peripheral line.

Figure 5:
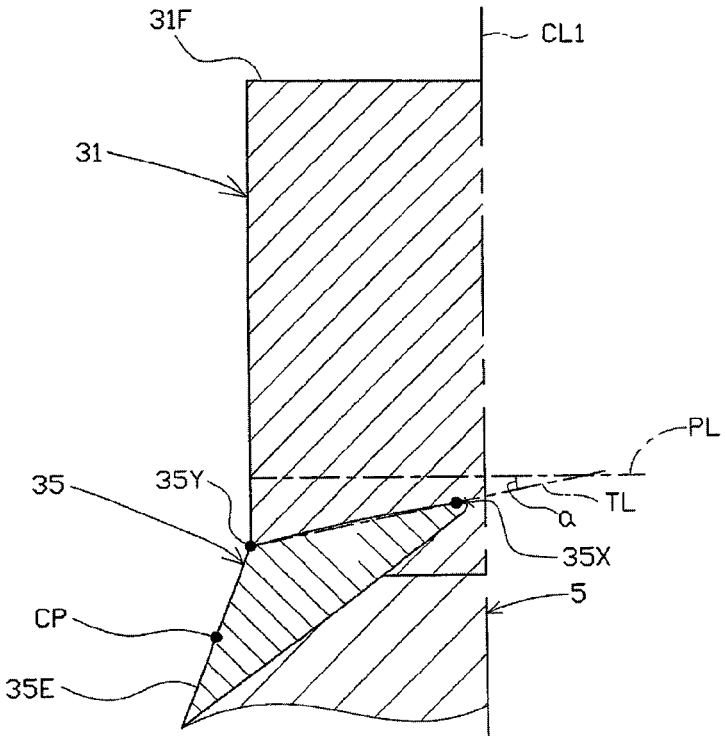

Furthermore, the present embodiment is configured such that the relational expression 30≥a is satisfied, where, as shown in FIG. 5, a (°) is an acute angle between the outline of the distal end surface of the tip 31 (in FIG. 5, a straight line PL parallel to the outline) and a straight line TL which connects a portion 35X of the fusion zone 35 located closest in the fusion zone 35 to the distal end surface 31F of the tip 31 and a forward end portion 35Y with respect to the direction of the axis CL1 of the fusion zone 35 on the side surface of the tip 31. That is, the present embodiment is configured such that a portion of the fusion zone 35 located toward the center does not excessively penetrate into the tip 31 toward the distal end surface 31F of the tip 31, whereby a sufficient thickness is ensured for a portion of the tip 31 located toward the center.

Figure 6:
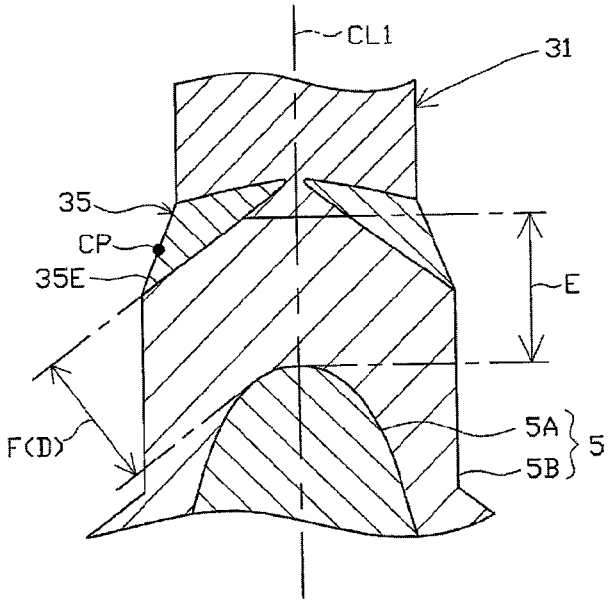
FIG. 6 is an enlarged sectional view of the fusion zones, etc., for explaining distance D.

Additionally, the present embodiment is configured such that the relational expression D≤2.0 is satisfied, where, as shown in FIG. 6, D (mm) is a shortest distance E between the tip 31 and the inner layer 5A of the center electrode 5 or a shortest distance F between the fusion zone 35 and the inner layer 5A, whichever is shorter (in the present embodiment, the shortest distance F is the distance D).

The present embodiment is configured such that the above-mentioned relational expressions (C−B≥0.02, 30≥a, and D≤2.0) are satisfied in sections which contain the axis CL1 and pass through the centers CP of the exposed surfaces 35E. However, it is not necessary to satisfy the above-mentioned relational expressions with respect to all of the fusion zones 35 (exposed surfaces 35E), but the relational expressions may be satisfied in a section which contains the axis CL1 and passes through at least one of the centers CP of the exposed surfaces 35E (however, it is more preferable to satisfy the relational expressions with respect to a plurality of the exposed surfaces 35E). All of the above-mentioned relational expressions are not necessarily satisfied, but satisfying at least the relational expression C−B≥0.02 suffices.

As described above in detail, the present embodiment is configured such that the distance B and the distance C satisfy the relational expression C−B≥0.02 mm; i.e., a portion of the tip 31 located toward the side surface of the tip 31 is sufficiently greater in thickness than a portion of the tip 31 located toward the center (axis CL1). Therefore, a large thickness is ensured for a portion of the tip 31 whose erosion is apt to progress, so that without need to increase the thickness (height) of the tip 31, exposure of the fusion zone 35 to the spark discharge gap 33 can be restrained over a long period of time. That is, according to the present embodiment, without involvement of an increase in material cost, durability can be drastically improved, and, in turn, service life can be further elongated.

Furthermore, the present embodiment is configured such that the relational expression 30°≥a is satisfied; i.e., an inwardly located portion of the fusion zone 35 does not excessively penetrate into the tip 31. Therefore, a surface of the fusion zone 35 located on a side toward the tip 31 is similar in shape to an eroded distal end surface of the tip 31; as a result, the fusion zone 35 is not exposed to the spark discharge gap 33 until almost all of the tip 31 is eroded away (i.e., the tip 31 is used quite effectively). Thus, exposure of the fusion zone 35 to the spark discharge gap 33 can be prevented over a very long period of time, so that durability can be further improved.

Also, through satisfaction of the relational expression D≤2.0, heat of the tip 31 can be efficiently conducted to the inner layer 5A having superior thermal conductivity. Therefore, overheating of the tip 31 can be restrained, whereby durability can be further enhanced.

Additionally, according to the present embodiment, the tip 31 is formed of Ir, Pt, W, Pd, or an alloy which contains at least one of the metals as a main component. Thus, erosion resistance and oxidation resistance of the tip 31 can be further improved, whereby durability can be further improved.

Figure 7:
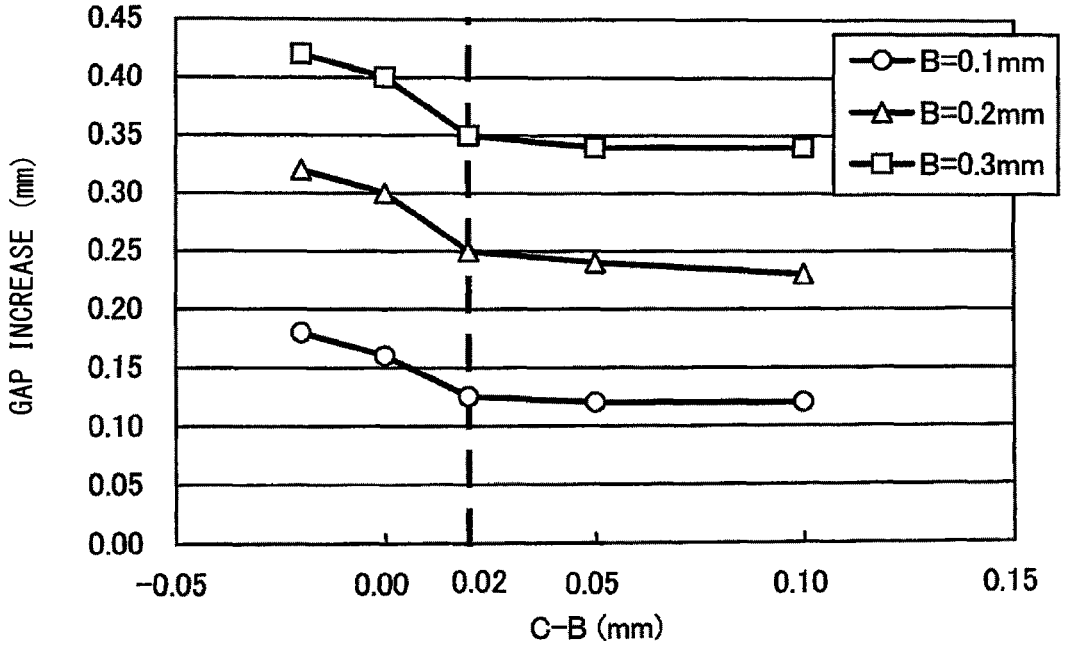
FIG. 7 is a graph showing the results of an erosion resistance evaluation test conducted on samples which differ in C−B.

Next, in order to verify actions and effects to be yielded by the above embodiment, there were manufactured spark plug samples which had a distance B of 0.1 mm, 0.2 mm, or 0.3 mm (at a distance B of 0.1 mm, a tip having a height of 0.2 mm was used; at a distance B of 0.2 mm, a tip having a height of 0.3 mm was used; and at a distance B of 0.3 mm, a tip having a height of 0.4 mm was used) and which differed in the distance C through adjustment of a fiber laser beam radiation angle. The samples were subjected to an erosion resistance evaluation test. The outline of the erosion resistance evaluation test is as follows. The samples were mounted to a predetermined chamber, and the pressure within the chamber was set to 0.4 MP by means of air. Next, by use of an ignition coil having an output energy of 60 mJ and an output frequency of 60 Hz, the samples having a distance B of 0.1 mm were caused to discharge for 75 hours; the samples having a distance B of 0.2 mm were caused to discharge for 150 hours;

and the samples having a distance B of 0.3 mm were caused to discharge for 200 hours [the discharge time was changed in consideration of a difference in the distance between the fusion zone and the distal end surface of the tip (tip thickness) resulting from a difference in the distance B (tip height)]. After the discharge, the spark discharge gaps (the greatest gaps) of the samples were measured, and there were calculated increases of the gaps (gap increases) as compared with the spark discharge gaps of the samples before the test. FIG. 7 is a graph showing the relation between the value of C−B and the gap increase. In FIG. 7, the test results of the samples having a distance B of 0.1 mm are plotted with circles; the test results of the samples having a distance B of 0.2 mm are plotted with triangles; and the test results of the samples having a distance B of 0.3 mm are plotted with squares. Since the discharge time differs with the distance B, the gap increase increases with the distance B.

Additionally, the samples had a tip formed of an Ir alloy and an outside diameter of 0.8 mm. Also, the ground electrodes had respective protrusions formed of a Pt alloy and having an outside diameter of 0.7 mm and a height of 0.8 mm. Furthermore, the samples had a spark discharge gap of 0.8 mm before the test.

As is apparent from FIG. 7, the samples having a C−B value less than 0.02 mm exhibited relatively large gap increases, indicating inferior durability. Conceivably, this is for the following reason: a side portion of the tip is particularly apt to progress in erosion; in this connection, through employment of a C−B value less than 0.02 mm, a portion of the fusion zone located toward the side surface of the tip was exposed to the spark discharge gap at a relatively early stage.

By contrast, the samples having a C−B value of 0.02 mm or more exhibited reduced gap increases, indicating superior durability. Conceivably, this is for the following reason: a sufficient thickness was ensured for a side portion of the tip which was particularly apt to be eroded, so that the fusion zone was unlikely to be exposed to the spark discharge gap.

From the results of the tests mentioned above, in order to improve durability, preferably, the relational expression C−B≥0.02 mm is satisfied.

Figure 8:
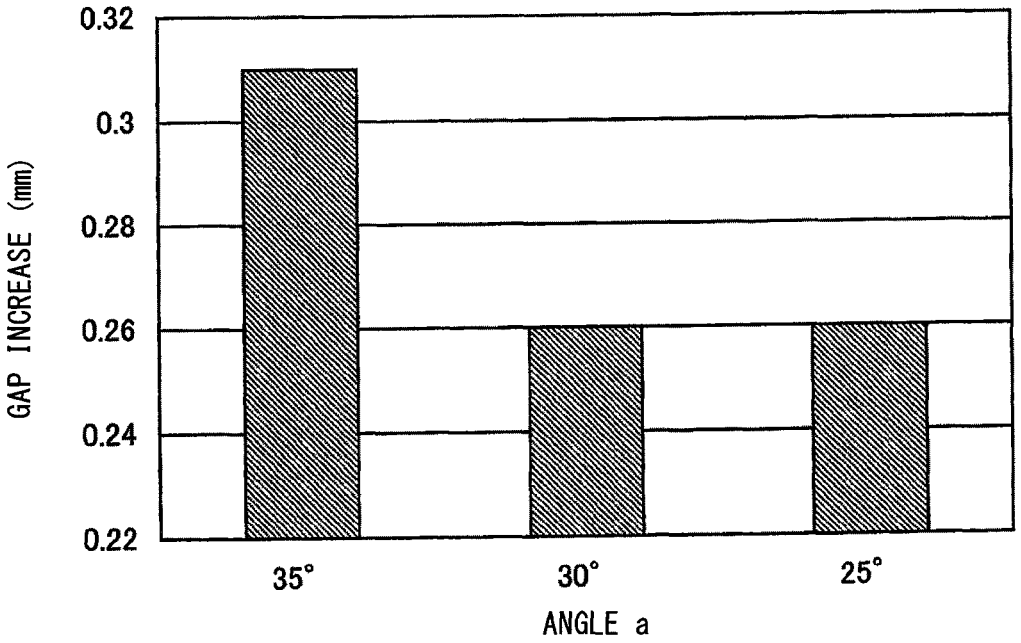

Next, there were manufactured spark plug samples which had a C−B value of 0.2 mm and had an angle a of 35°, 30°, or 25° through change of the radiation angle of the fiber laser beam. The samples were subjected to the above-mentioned erosion resistance evaluation test at a discharge time of 200 hours. FIG. 8 shows the results of the test. The samples had a tip formed of an Ir alloy and an outside diameter of 0.8 mm and a height of 0.5 mm. Also, the ground electrodes had respective protrusions formed of a Pt alloy and having an outside diameter of 0.7 mm and a height of 0.8 mm. The samples had a spark discharge gap of 0.8 mm before the test.

As is apparent from FIG. 8, the samples having an angle a of 30° or less had far superior durability. Conceivably, this is for the following reason: through employment of an angle a of 30° or less, a surface of the fusion zone located on a side toward the tip was similar in shape to an eroded distal end surface of the tip; as a result, the tip was effectively used (i.e., the fusion zone was not exposed to the spark discharge gap until almost all of the tip was eroded away); thus, exposure of the fusion zone to the spark discharge gap was prevented over a very long period of time.

From the results of the test mentioned above, in order to further improve durability, preferably, the relational expression 30°≥a is satisfied.

Figure 9:
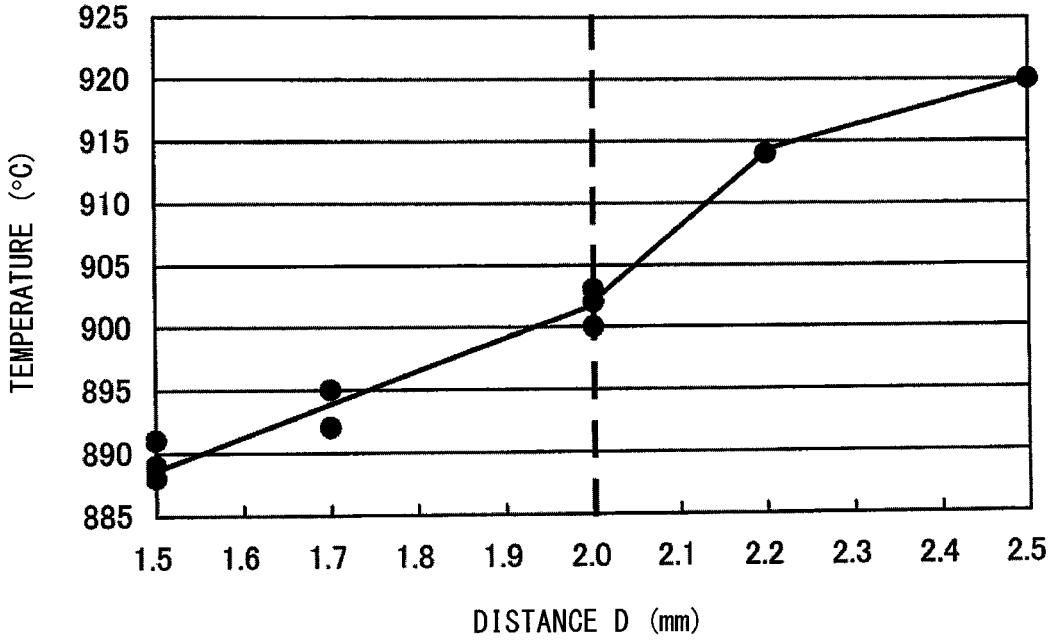
FIG. 9 is a graph showing the results of a desktop burner test conducted on samples which differ in distance D.

Next, there were manufactured spark plug samples which had a shortest distance E between the tip and the inner layer of 1.5 mm, 2.0 mm, or 2.5 mm and differed in the distance D (the shortest distance E or the shortest distance F, whichever is shorter) through change of the shortest distance F between the fusion zone and the inner surface. The samples were subjected to a desktop burner test. The outline of the desktop burner test is as follows. Forward end portions of the samples were heated under the condition that the tip temperature was about 900° C. at a shortest distance E and a shortest distance F of 2.0 mm, and tip temperatures were measured during heating. The lower the tip temperature, the more oxidation resistance and erosion resistance of the tip can be improved; thus, a low tip temperature can be said to be preferable in view of durability of the tip. Table 1 and FIG. 9 show the results of the test. The samples had a tip formed of an Ir alloy and an outside diameter of 0.8 mm and a height of 0.5 mm.

TABLE 1

| Shortest distance E (mm) | Shortest distance F (mm) | Distance D (mm) | Temp. (° C.) |
|---|---|---|---|
| 1.5 | 1.8 | 1.5 | 889 |
| | 2.0 | 1.5 | 888 |
| | 2.2 | 1.5 | 891 |
| 2.0 | 1.7 | 1.7 | 892 |
| | 2.0 | 2.0 | 900 |
| | 2.3 | 2.0 | 903 |
| 2.5 | 1.7 | 1.7 | 895 |
| | 2.0 | 2.0 | 902 |
| | 2.2 | 2.2 | 914 |
| | 2.5 | 2.5 | 920 |

As is apparent from Table 1 and FIG. 9, through employment of a distance D of 2.0 mm or less, the tip temperature drops greatly during heating, indicating that overheating of the tip can be effectively restrained.

From the results of the test mentioned above, in view of further improvement of durability, preferably, the relational expression D≤2.0 mm is satisfied.

The present invention is not limited to the above-described embodiment, but may be embodied, for example, as follows. Of course, applications and modifications other than those exemplified below are also possible.

Figure 10:
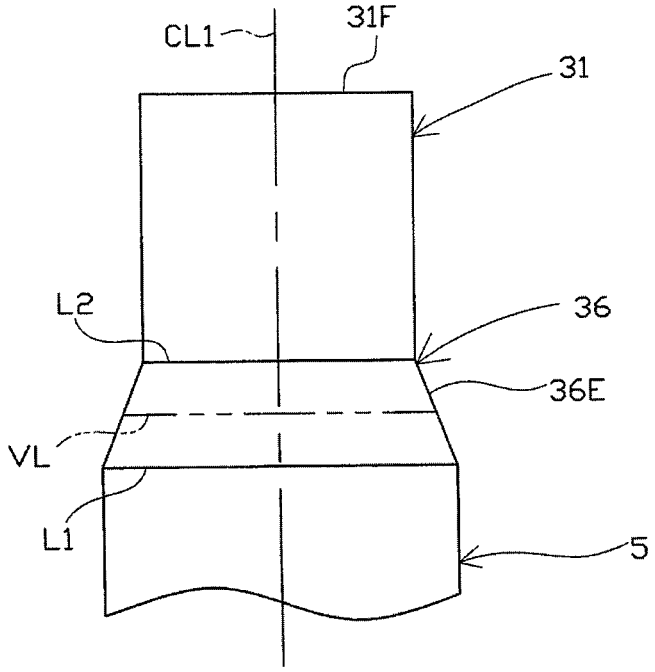
FIG. 10 is a fragmentary enlarged front view showing the configuration of a fusion zone in another embodiment.

(a) In the embodiment described above, the fusion zones 35 are formed through intermittent radiation of a laser beam or the like; however, the fusion zone may be formed by means of the laser beam or the like being continuously radiated while being moved relative to the center electrode 5. In this case, as shown in FIG. 10, a fusion zone 36 has an exposed surface 36E exposed at its outer surface and extending along the circumferential direction of the center electrode 5. At this time, the "center of the exposed surface 36E" means a point which resides on an imaginary line VL located at the center between a line segment L1 of the peripheral line of the exposed surface 36E located on a side toward the center electrode 5 and a line segment L2 of the peripheral line located on a side toward the tip 31 and which resides where the width between the line segment L1 on the side toward the center electrode 5 and the line segment L2 on the side toward the tip 31 is the greatest. This is for the following reason: in a section which contains the axis CL1 and passes through the point, a most inward portion of the fusion zone 36 is considered to appear.

Figure 11:
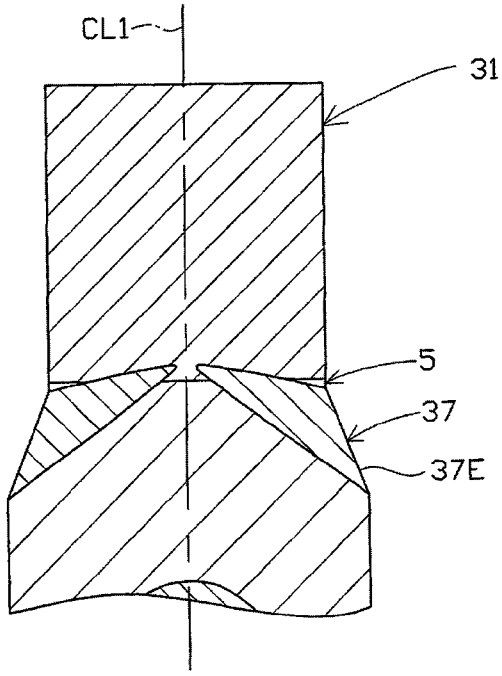
FIG. 11 is an enlarged sectional view showing the configuration of fusion zones in a further embodiment.

(b) In the embodiment described above, the exposed surfaces 35E are formed in such a manner as to extend into the side surface of the center electrode 5 and into the side surface of the tip 31; however, for example, through change of the position of radiation of the laser beam or the like to the rear side with respect to the direction of the axis CL1, as shown in FIG. 11, the position of formation of fusion zones 37 may be adjusted such that exposed surfaces 37E are formed only on the side surface of the center electrode 5. That is, configuration may be such that a side portion of the tip 31 is not fused. In this case, thickness can be ensured to the possible greatest extent for a side portion of the tip 31 which is particularly apt to be eroded, so that erosion resistance can be further improved. Also, since the exposed surface is not formed on the side surface of the tip 31, quality of external appearance can be improved.

Figure 12:
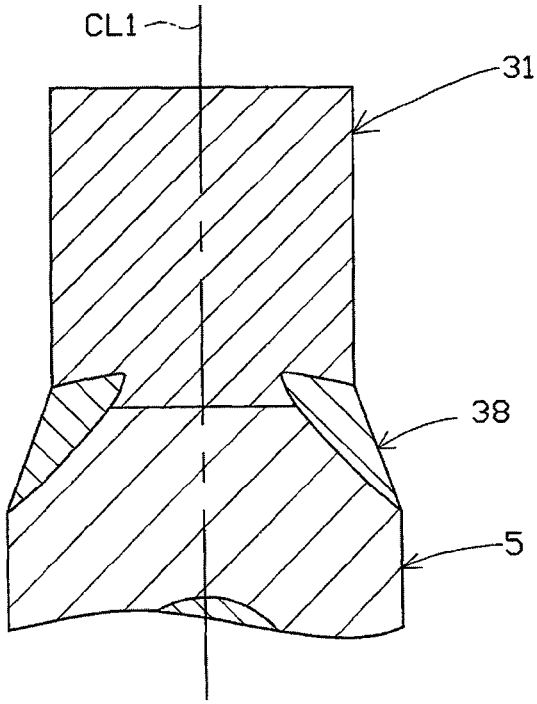
FIG. 12 is an enlarged sectional view showing the configuration of fusion zones in a still further embodiment.
Figure 13:
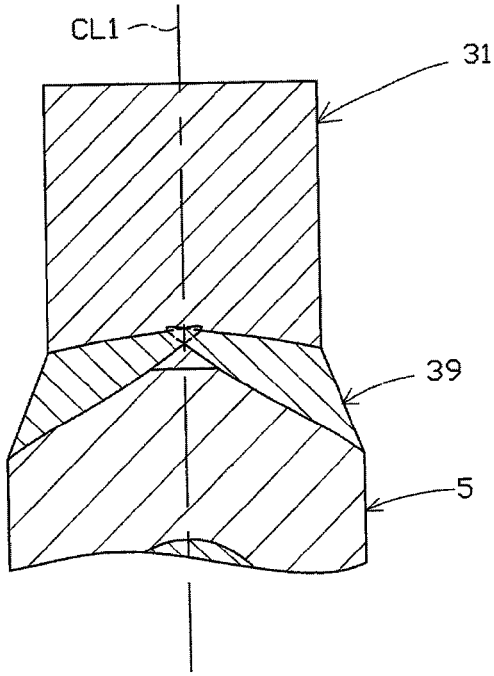
FIG. 13 is an enlarged sectional view showing the configuration of fusion zones in a yet another embodiment.

(c) The amount of inward penetration of the fusion zones 35 in the embodiment described above is an example. The amount of penetration of the fusion zones 35 may be at least such an extent as to enable joining of the tip 31 to the center electrode 5. Therefore, for example, as shown in FIG. 12, fusion zones 38 may have a relatively small amount of inward penetration. Also, as shown in FIG. 13, fusion zones 39 may penetrate inward beyond the axis CL1.

Figure 14:
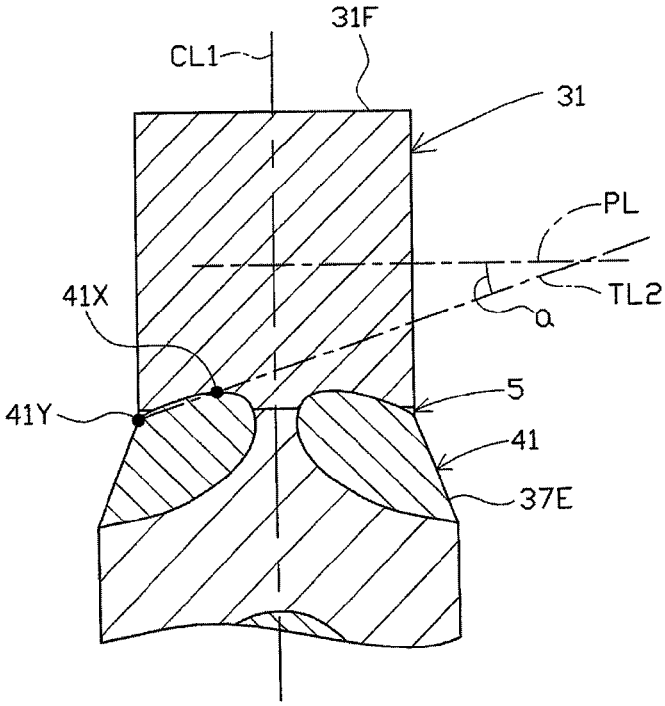
FIG. 14 is an enlarged sectional view showing the configuration of fusion zones in another embodiment.
Figure 15:
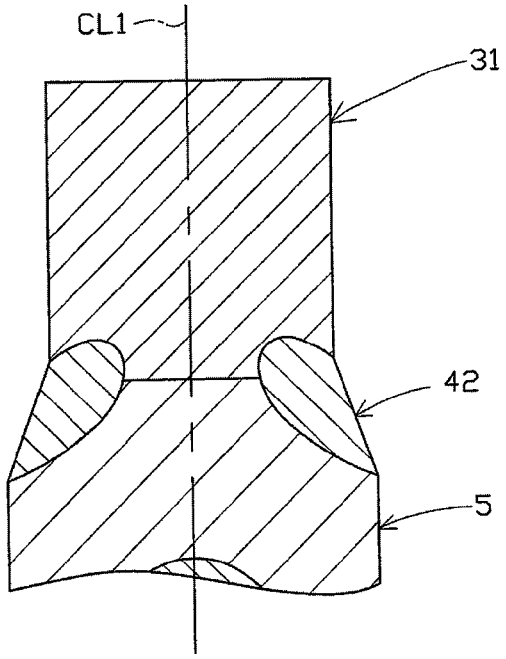
FIG. 15 is an enlarged sectional view showing the configuration of fusion zones in a further embodiment.
Figure 16:
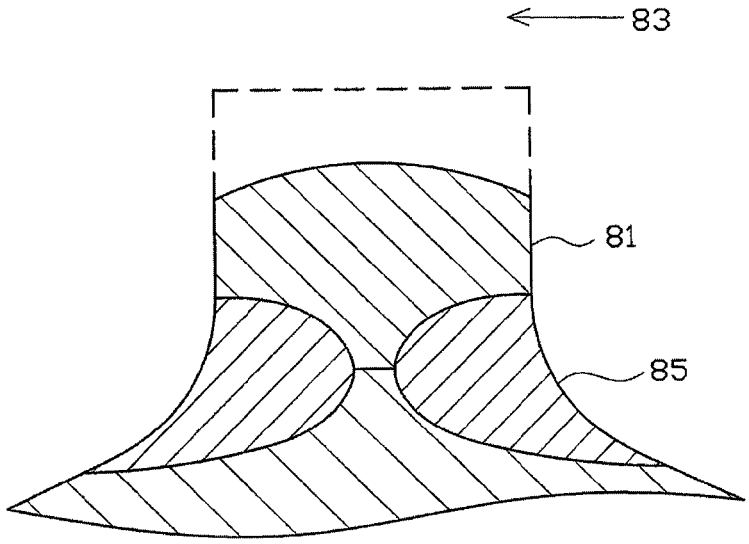
FIG. 16 is an enlarged sectional view showing the configuration of fusion zones, etc., according to a conventional technique.
Figure 17:
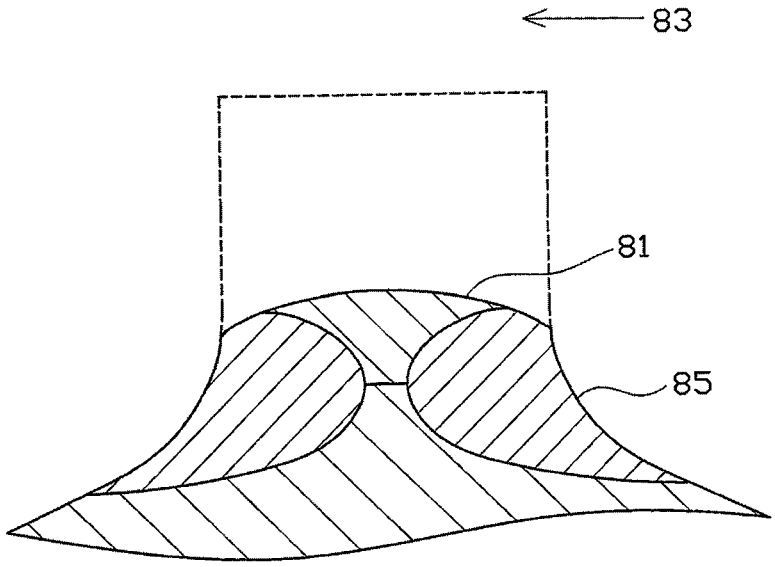
FIG. 17 is an enlarged sectional view showing the configuration of fusion zones, etc., according to a conventional technique at a stage where erosion of a tip has progressed.

(d) According to the embodiment described above, in the aforementioned section, the outline of the fusion zone 35 assumes the form of a straight line on the side toward the tip 31 and on the side toward the center electrode 5 and assumes the form of an acute angle on the side toward the axis CL1; however, the sectional shape of the fusion zone 35 is not limited thereto. For example, as shown in FIGS. 14 and 15, the outlines of fusion zones 41 and 42 may be curved in such a manner as to be expanded toward the tip 31 and toward the center electrode 5. Such fusion zones 41 and 42 can be formed through use of YAG laser in joining the tip 31 to the center electrode 5. Even in such a case, as shown in FIG. 14, the angle a is an acute angle between the outline of the distal end surface 31F of the tip 31 (in FIG. 14, the straight line PL parallel to the outline) and a straight line TL2 which connects a portion 41X of the fusion zone 41 located closest in the fusion zone 41 to the distal end surface 31F of the tip 31 and a forward end portion 41Y with respect to the direction of the axis CL1 of the fusion zone 41 on the side surface of the tip 31.

(e) In the embodiment described above, the spark discharge gap 33 is formed between the protrusion 27P and a distal end portion of the tip 31. However, without provision of the protrusion 27P on the ground electrode 27, the spark discharge gap 33 may be formed between a distal end portion of the tip 31 and a surface of the ground electrode 27 which faces the tip 31.

(f) In the embodiment described above, the ground electrode 27 is joined to the forward end portion 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(g) In the embodiment described above, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

DESCRIPTION OF REFERENCE NUMERALS

1: spark plug
2: ceramic insulator (insulator)
3: metallic shell
4: axial bore
5: center electrode
5A: inner layer
5B: outer layer
27: ground electrode
31: tip
31F: distal end surface (of tip)
33: spark discharge gap (gap)
35: fusion zone
35E: exposed surface
CL1: axis
CP: center (of exposed surface)
TL: straight line

The invention claimed is:

1. A spark plug comprising:
a center electrode extending in a direction of an axis;
a tubular insulator having an axial bore into which the center electrode is inserted;
a tubular metallic shell provided externally of an outer circumference of the insulator;
a ground electrode disposed at a forward end portion of the metallic shell; and
a tip whose proximal end portion is joined to a forward end portion of the center electrode and whose distal end portion forms a gap in cooperation with a distal end portion of the ground electrode
wherein,
the tip is joined to the center electrode via a fusion zone which is formed through radiation of a laser beam or an electron beam toward a side surface of the center electrode and in which the tip and the center electrode are fused together,
the fusion zone is located toward a side from which the laser beam or the electron beam is radiated, and includes an exposed surface exposed to an external environment, and
in a section which contains the axis and passes through a center of the exposed surface,
a relational expression $C-B \geq 0.02$ mm is satisfied, where
C (mm) is a distance along the axis on a side surface of the tip between the fusion zone and a distal end of the tip, and
B (mm) is a distance along the axis between a distal end surface of the tip and a portion of the fusion zone located closer to the axis than the side surface of the tip and located closest in the fusion zone to the distal end surface of the tip.

2. The spark plug according to claim 1, wherein
in the section which contains the axis and passes through the center of the exposed surface,
a relational expression $30° \geq a$ is satisfied, where
a (°) is an acute angle between an outline of the distal end surface of the tip and a straight line which connects a portion of the fusion zone located closest in the fusion zone to the distal end surface of the tip and a forward end portion with respect to the direction of the axis of the fusion zone on the side surface of the tip.

3. The spark plug according to claim 1, wherein
the center electrode includes an outer layer and an inner layer, said inner layer being provided in the interior of the outer layer and formed of a metal higher in thermal conductivity than a metal of the outer layer, and
in the section which contains the axis and passes through the center of the exposed surface,
a relational expression $D \leq 2.0$ mm is satisfied, where
D (mm) is a shortest distance between the tip and the inner layer or a shortest distance between the fusion zone and the inner layer, whichever is shorter.

4. The spark plug according to claim 1, wherein the exposed surface is formed only on a side surface of the center electrode.

5. The spark plug according to claim 1, wherein the tip is formed of a metal selected from the group consisting of; iridium, platinum, tungsten, palladium, and an alloy which contains at least one of the metals as a main component.

6. The spark plug according to claim 2, wherein the center electrode includes an outer layer and an inner layer, said inner layer being provided in the interior of the outer layer and formed of a metal higher in thermal conductivity than a metal of the outer layer, and in the section which contains the axis and passes through the center of the exposed surface, a relational expression $D \leq 2.0$ mm is satisfied, where D (mm) is a shortest distance between the tip and the inner layer or a shortest distance between the fusion zone and the inner layer, whichever is shorter.

7. The spark plug according to claim 2, wherein the exposed surface is formed only on a side surface of the center electrode.

8. The spark plug according to claim 3, wherein the exposed surface is formed only on a side surface of the center electrode.

9. The spark plug according to claim 2, wherein the tip is formed of a metal selected from the group consisting of; iridium, platinum, tungsten, palladium, and an alloy which contains at least one of the metals as a main component.

10. The spark plug according to claim 3, wherein the tip is formed of a metal selected from the group consisting of; iridium, platinum, tungsten, palladium, and an alloy which contains at least one of the metals as a main component.

11. The spark plug according to claim 4, wherein the tip is formed of a metal selected from the group consisting of; iridium, platinum, tungsten, palladium, and an alloy which contains at least one of the metals as a main component.

* * * * *